US005458097A

United States Patent [19]

Devine et al.

[11] Patent Number: 5,458,097

[45] Date of Patent: Oct. 17, 1995

[54] LIGHT WEIGHT VALVE LIFTER

[75] Inventors: Douglas L. Devine, Marshall; David G. Williamson, Battle Creek, both of Mich.

[73] Assignee: Eaton Corporation, Cleveland, Ohio

[21] Appl. No.: 357,483

[22] Filed: Dec. 16, 1994

[51] Int. Cl.[6] ..... F01L 1/14

[52] U.S. Cl. ..... 123/90.48; 123/90.51; 123/90.35; 74/569

[58] Field of Search ..... 123/90.33, 90.35, 123/90.48, 90.51; 74/569

[56] References Cited

U.S. PATENT DOCUMENTS

| | | | |
|---|---|---|---|
| 3,234,815 | 2/1966 | Line | 123/90.48 |
| 3,303,833 | 2/1967 | Melling | 123/90.48 |
| 3,470,983 | 10/1969 | Briggs | 123/90.35 |
| 3,683,876 | 8/1972 | Lesher | 123/90.35 |
| 4,475,490 | 10/1984 | Oono et al. | 123/90.48 |

*Primary Examiner*—Henry C. Yuen
*Assistant Examiner*—Weilun Lo
*Attorney, Agent, or Firm*—Frank M. Sajovec

[57] ABSTRACT

A mechanical valve lifter for racing applications. A very light weight valve lifter is formed by a structure which includes a thin-walled tubular outer member and a solid core member having spaced apart flanges or disks formed integral therewith to support the outer member. A plasma transferred arc welded cam-contacting surface is formed on one end of the lifter and a pushrod-contacting surface is formed on the other end.

5 Claims, 1 Drawing Sheet

LIGHT WEIGHT VALVE LIFTER

The present invention relates generally to lash compensating devices for internal combustion engines, and more specifically to a light weight valve lifter particularly adapted to racing engine applications.

Engines used in auto racing are obviously subject to different design criteria from passenger car engines, with great emphasis being placed on a high power to weight ratio and with durability requirements for many components which are measured in terms of the ability to complete a single race. As applied to lash compensating devices the above criteria translate into the need for a non-adjustable, mechanical lash compensating element of extremely light weight and with wear surfaces which are selectively applied to satisfy the durability requirements for a particular application while adding as little weight as possible.

In addition to the above requirements the organizations which sanction the various classes of auto racing have certain rules applicable to the engines used in each class in which apply restrictions on design and materials. The present invention is designed under rules of the National Association for Stock Car Auto Racing (NASCAR) which require the use of pushrod engines (no overhead cams) and flat-faced valve lifters (no roller followers). Current NASCAR rules further require that the valve lifter be fabricated of iron or steel.

Currently, NASCAR valve lifters are made of chilled or hardenable iron and weigh between 77 and 96.5 grams. In addition to a need for lighter weight, a wear problem at the cam/lifter interface has required the application of a welded hardfacing material to the cam lobes. This is unacceptably costly to the cam supplier.

Attempts have been made to provide a thin walled version of a conventional barrel lifter made from SAE 1050 steel and faced with a welded hardfacing material. While this design eliminates the need for applying a hardfacing to the cam lobes it is still heavier than desired.

Based on the above, it is an object of the present invention to provide a valve lifter under NASCAR rules which is of extremely light weight, which is capable of operating against a conventional cam lobe material, and which will complete at least one NASCAR-sanctioned race without failure.

To meet the above objectives, a preferred embodiment of the present invention provides a two-piece lifter comprising a thin-walled outer shell supported by an internal pedestal structure which is welded to the shell. The cam contacting surface of the pedestal has a welded layer of hard facing material applied to it.

Other objectives and advantages of the invention will be apparent from the following description when considered in connection with the accompanying drawings, wherein.

Figure 1:
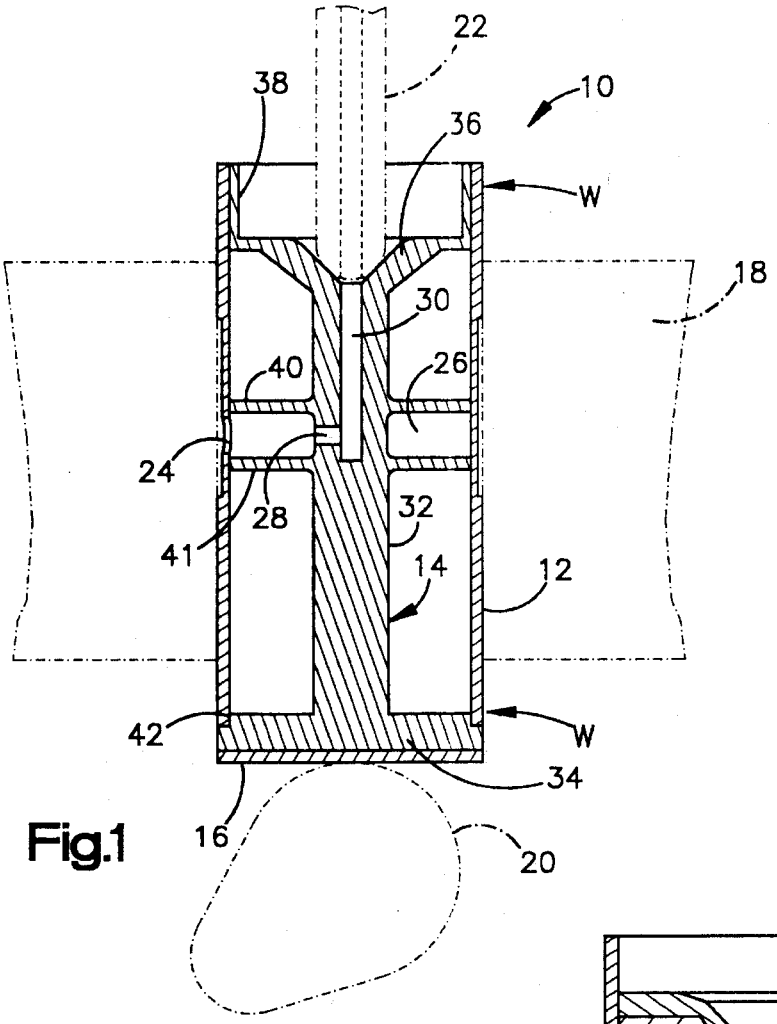
FIG. 1 is a cross-sectional view of the invention.

Referring to FIG. 1, there is illustrated a valve lifter 10 comprising a thin-walled cylindrical member 12, a pedestal member 14 received within the cylinder, and a hardfaced surface 16 formed on one end of the pedestal. The valve lifter is shown generally as installed in sliding relation within an engine block 18 between a cam 20 and a pushrod 22 in a conventional manner. To provide lubricating oil to the remainder of the valve train components, the invention provides an oil flow path from a gallery (not shown) within the block 18 through a port 24 formed in the wall of the cylindrical member, an annular chamber 26 formed between the member 12 and the pedestal 14, a radial port 28 formed in the pedestal, and a blind, axial bore 30 formed in the pedestal and intersecting the port 28. The pushrod 22 is hollow to complete the oil path to the remainder of the valve train.

The pedestal 14 is preferably formed of SAE 1018 steel and includes a central core 32 which flares out into a cam-engaging head portion 34 and a pushrod-engaging portion 36. The pushrod-engaging portion also flares outward from the core and includes a barrel section 38 which serves to support the cylindrical member 12. To define the annular chamber 26 and to provide support for the cylindrical member, two spaced apart disks 40, 41 are formed integrally with the core in straddling relation to the port 28.

The cylindrical member 12 is a thin-walled cylinder preferably formed of SAE 1018 steel which is received against a shoulder 42 formed in the head portion 34 and over the barrel section 38. In the preferred embodiment the cylinder and core are welded together by means of a laser welding process applied in the areas designated by the arrows W. Laser welding is a well known process and will not be described herein in detail.

The hardfacing material 16 which defines the cam-contacting face of the lifter can be applied in a variety of ways; however, a preferred method is one employing a plasma transferred arc (PTA) welding process as described in U.S. Pat. No. 5,293,026, which is assigned to the assignee of this application and which is incorporated herein by reference. A preferred hardfacing material is an iron powder containing nickel, molybdenum and chromium, an example of which is a material designated EMS-563.

Figure 2:
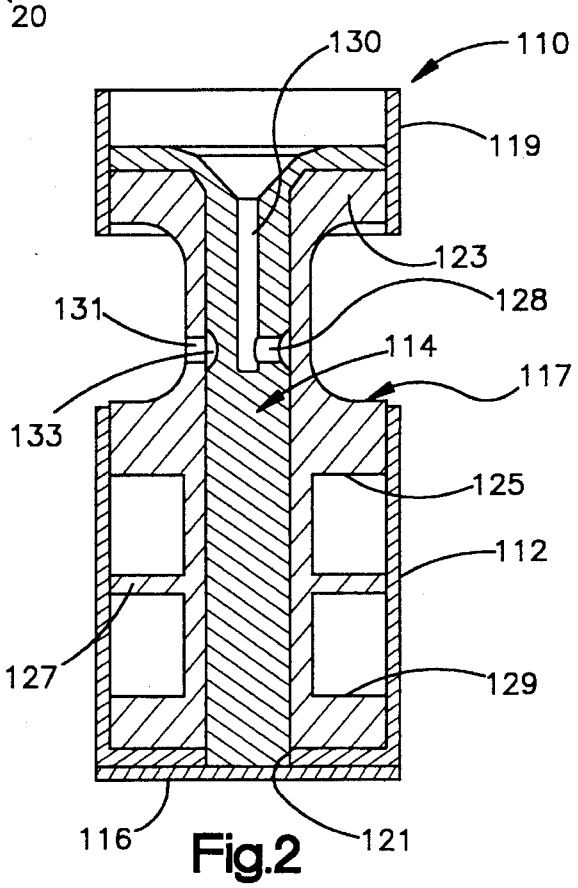
FIG. 2 is a cross sectional view of an alternative embodiment of the invention.

Referring to FIG. 2, there is illustrated an embodiment 110 of the present valve lifter, which is a functional alternative to the FIG. 1 embodiment but which does not conform to current NASCAR material requirements. The FIG. 2 embodiment includes a cylindrical outer member 112 formed of SAE 1018 steel, a pedestal or core member 114 formed of SAE 1018 steel, a hardfaced surface 116 formed of EMS 563, and an intermediate member 117 formed of SAE 1061 titanium-aluminum. In this embodiment a barrel portion 119 which defines the outer diameter of the upper portion of the lifter is formed integrally with the core 114.

The outer diameter of the lower portion of the lifter is defined by the cylindrical member 112, which in this embodiment is in the form of a cup shaped member having a central hole 1 21 formed in the closed end, through which the core 114 protrudes.

The intermediate member 117 is formed as a hollow cylinder having a plurality of flange sections formed thereon to support the cylindrical member 112 and the barrel portion 119. A first flange section 123 supports the barrel portion 119, and second, third and fourth flange sections 125, 127 and 129 respectively support the cylindrical member 112. In a preferred construction, the core 114 is press fit into the intermediate member, and the cylindrical member 112 is press fit over the intermediate member. To complete the oil path to the remainder of the valve train, a radial port 131 is formed in the intermediate member between the first and second flange sections and in alignment with an annular groove 133 formed in the core member. A radial port 128 intersects the groove 133 and a blind axial bore 130.

The hardfacing surface 116 is formed over the closed end of the cylindrical member 112 and the protruding portion of the core 114 in the same manner as described with respect to the FIG. 1 embodiment.

We claim:

1. A mechanical valve lifter comprising an outer cylindrical member slidingly engageable with the block of an internal combustion engine, an inner cylindrical member coaxial with the outer cylindrical member in supporting relation therewith, said inner and outer cylindrical members defining a cylindrical assembly; a cam-contacting surface formed on one end of said cylindrical assembly; a pushrod-contacting surface formed at the opposite end of said cylindrical assembly; and means formed in said assembly for conducting oil from a region defined by the outer surface of said outer cylindrical member to said pushrod contacting surface, wherein the improvement comprises said outer cylindrical member comprising a thin-walled tubed, and said inner cylindrical member comprising a substantially solid rod member having a first radially outwardly extending portion formed at one end and a second radially outwardly extending portion formed at the opposite end; said first radially outwardly extending portion defining a base member on which said cam contacting surface is formed and said second radially outwardly extending portion defining said pushrod-contacting surface.

2. Apparatus as claimed in claim 1 in which said second radially outwardly extending portion comprises a radially extending web portion and an axially extending barrel portion, said outer cylindrical member being fixed to said barrel portion by welding.

3. Apparatus as claimed in claim 1 including one or more spaced apart disks formed integrally with said rod member between said first and second outwardly extending portions and in engagement with said outer cylindrical member.

4. Apparatus as claimed in clam 3 including at least two of said spaced apart disks and said means for conducting oil comprises a first radial port formed through said outer cylindrical member between two of said disks, a second radial port formed in said rod member between said two of said disks, and an axial bore formed in said rod member intersecting said second radial bore and said pushrod-contacting surface.

5. Apparatus as claimed in any one of claims 1, 2, 3 or 4 in which said inner and outer cylindrical members are formed of steel and said cam- contacting surface is formed by an iron powder applied to said base member by a plasma transferred arc welding process.

* * * * *